United States Patent [19]

Tribert

[11] Patent Number: 4,960,156

[45] Date of Patent: Oct. 2, 1990

[54] METHOD AND APPARATUS FOR TOPPING OFF CONTAINERS WITH LIQUID TO PREDETERMINED HEADSPACE LEVEL

[75] Inventor: Claude Tribert, Bedminster, N.J.

[73] Assignee: Howden Food Equipment, Inc., Boston, Mass.

[21] Appl. No.: 297,139

[22] Filed: Jan. 13, 1989

[51] Int. Cl.[5] ..... B65B 3/08

[52] U.S. Cl. ..... 141/1; 141/131; 141/134; 141/168; 141/171; 141/86; 141/135

[58] Field of Search ..... 141/1, 86, 91, 124, 141/126, 131, 132, 133, 134, 135, 168, 170, 171

[56] References Cited

U.S. PATENT DOCUMENTS

| | | | |
|---|---|---|---|
| 2,801,650 | 8/1957 | Breeback | 141/1 |
| 3,298,404 | 1/1967 | Eisenberg | 141/131 |
| 3,771,576 | 11/1973 | Gellatly et al. | 141/171 |
| 3,834,431 | 9/1974 | Zittel et al. | 141/131 |
| 3,903,938 | 9/1975 | Osborne | 141/131 |
| 3,994,321 | 11/1976 | Eisenberg | 141/131 |
| 4,103,720 | 8/1978 | Eisenberg | 141/1 |
| 4,349,053 | 9/1982 | Eisenberg | 141/1 |

OTHER PUBLICATIONS

PCT Application-PCT/DE83/00049, Sep. 29, 1983, see the abstract, and all the Figures.

*Primary Examiner*—Henry J. Recla
*Assistant Examiner*—Edward C. Donovan
*Attorney, Agent, or Firm*—Kenyon & Kenyon

[57] ABSTRACT

Accurately reproducible filling to a selected headspace level of a rapidly moving line of containers is obtained by using a single feeder screw through at least a final portion of a filling region and an outfeed zone following the filling region. The containers are tilted to a predetermined angle, depending on the selected headspace level, during their progress through the filling region and then return smoothly to an upright condition in the outfeed transition zone, without splashing any of the liquid content. Apparatus for filling the containers includes a container support structure in the filling region that can be adjusted through a range of tilt angles in an arc centered on the longitudinal axis of the feeder screw. The apparatus also includes an elongated funnel for delivering liquid to the containers and that can be pivoted forward to permit access to the filling region.

12 Claims, 5 Drawing Sheets

51
45
52
46
11
47
48
44
77
78
31
37
39
80
79
81
84
40
41
90
67
58
61
43
54
72
13
42
69
76
57
62
56
75
73
63
65
71
74
53
49
51
50

41
55
59
83
67
70
60
42
12
66
64
87
85
89a
89
68
46
47
48
51
39
13
43
71
73
75
74
77
37
88
88a
62
52
84
61
86
63
65
45
82
54
69
53

METHOD AND APPARATUS FOR TOPPING OFF CONTAINERS WITH LIQUID TO PREDETERMINED HEADSPACE LEVEL

BACKGROUND OF THE INVENTION

1. Field of the Invention

The invention relates to a method and apparatus for topping off a line of moving containers with liquid and particularly to filling rapidly moving tilted containers from a continuously flowing source to an accurately determined headspace level, without any subsequent spillage while returning the topped up containers to an upright condition.

2. Background Art

U.S. Pat. No. 4,103,720, issued to B. C. EISENBERG on 1 Aug. 1978, describes a method and apparatus for filling open-top containers with liquid material. The containers are advanced continuously in a line along a predetermined path through a filing region where liquid material is discharged from a reservoir in a continuous sheet over an inclined plate, the lower edge of which extends in the direction of advance above the open tops of the line of containers. In the filling region, the containers are tilted transversely to the path at a predetermined angle with respect to the vertical, and the flow rate of the liquid is adjusted so that each container is overfilled as it passes through the filling region.

To prevent the liquid stream from contacting the external surface of the containers, thus avoiding an extra cleanup step after filling, streams of air are directed towards the tilted containers transversely to the line of advance below their tops, so that the air passes around the peripheries of the containers adjacent to their tops. The air flow laterally deflects any part of the sheet of liquid which would otherwise flow between adjacent containers and also deflects the liquid overflowing from the lower part of the open top of each tilted container away from the side of the container. The deflected liquid falls into a trough below the line of containers and is recirculated from the trough back to the reservoir.

In U.S. Pat. No. 4,349,053 issued 14 Sept. 1982, also to EISENBERG, an endless series of moving deflecting units, in the form of spaced deflecting wedges or successive funnels, replace the airstream of EISENBERG '720. The deflecting units pass under the discharge edge of the inclined plate in synchronism with the line of containers and divide the continuous liquid sheet flowing over the plate into individual moving streams directed into corresponding ones of the containers in the moving line.

The inventions in both the EISENBERG '720 and '053 patents are concerned with preventing any contact of the liquid of the continuous flowing stream with the outside surfaces of the containers to eliminate any need to clean the containers before they are sealed. For many liquid filling or topping off operations, this is not so important. For example, containers of many canned food products such as vegetables, olives, and so forth, pass through a briner after they have been filled with the food product. The briner adds premixed salt water, or fresh water which dissolves a salt tablet or granular salt in each container, up to a predetermined headspace level. In either case, the added liquid creates no cleanup problem if it splashes onto the outside surfaces of the containers.

Consequently, a conventional briner as manufactured by the assignee of the present application, is a simpler machine than those of the EISENBERG '720 and '053 patents. The liquid flows from an elongated trough through a longitudinal slot in the center of the bottom of the trough as a continuous sheet directly into a line of tilted containers moving in a straight line through the filling region. There are no deflector units moving with the containers and no ductwork for delivering a stream of air across the line of containers.

Both the conventional briner and the more sophisticated machines of the EISENBERG '720 and '053 patents have a common problem, however. Containers enter and leave these machines in an upright condition. In the machine they pass through an entry transition zone, where they are transversely tilted to a predetermined angle depending on the desired headspace level, then through a filling region, and finally through an exit transition zone, where they are returned to the upright condition. An endless chain conveyor transports the containers along the filling path at rates up to 500 containers per minute. Typically, the containers enter the briner in random fashion, and after filling with brine, they go into a timer feed screw to enter the next station, such as a seamer. Because of random feeding of the containers to the timing screw, the transfer into the screw is never smooth. Splashing occurs. If the liquid is not replaced, product quality will suffer.

Because of the need to synchronize the containers with the deflector units in the machine of EISENBERG '053, arms on an endless loop driven with the deflector units push the containers through the filling region and the transition zones. In this machine, an infeed timer screw delivers the containers to the pusher arms, and the arms in turn deliver the containers to an outfeed screw. As with the briner chain conveyor, the transfer to the outfeed timing screw is not smooth, particularly when the machine is operating at high feed rates in the 500 cpm, and above range. Consequently, some splashing after leaving the filling region occurs with the transport mechanisms of all of these liquid fillers.

Splashing not only results in out of tolerance headspace in a significant number of containers; it also creates an environmental problem. Since the return trough of these filling machines extends only to the end of the filling region, any spills in the outfeed transition zone will go to the floor, requiring drains to a disposal system or sewer.

SUMMARY OF THE INVENTION

The present invention solves the problem of filling containers in a rapidly moving line of containers to provide an accurately reproducible headspace and without spilling or splashing outside the filling region.

The solution is to provide a single feeder screw that engages the containers continuously through at least a final portion of the filling region and through the outfeed transition zone. Preferably the same feeder screw engages the containers continuously from the beginning of the infeed transition zone to the exit of the outfeed transition zone. Also preferably, the containers are tilted, in the infeed transition zone, and returned to the upright condition, in the outfeed transition zone, in an arc centered on the longitudinal axis of the feeder screw. This assures that the containers remain in close, supported contact with the feeder screw and proceed smoothly through the entire filling process.

In particular, the invention includes a method for topping up a line of rapidly moving open top containers with liquid to an accurately reproducible headspace level in each container, the method including advancing a line of open top containers along a predetermined substantially straight path through an elongated filling region, tilting the containers to a predetermined angle during their passage through at least a final portion of the filling region, and discharging liquid in a stream extending longitudinally through the filling region in the direction of said predetermined path above the open tops of the containers, and returning the containers to an upright condition after they leave the filling region, wherein the improvement comprises the step of advancing the line of containers comprises engaging successive containers in the line with successive turns of a feeder screw extending parallel to the predetermined path through at least said final portion of the filling region, and continuing said engagement at least until the containers have returned to the upright condition.

The step of tilting the containers preferably comprises tilting the containers prior to their entry into the filling region and maintaining a constant angle of tilt until the containers leave the filling region.

The step of engaging the containers preferably comprises engaging each container with the rotating feeder screw prior to the tilting step, and the tilting step preferably comprises tilting the containers about the axis of the feeder screw. In addition, the step of returning the containers to the upright condition preferably also comprises rotating the containers about the axis of the feeder screw.

The invention also includes apparatus for topping up a line of rapidly moving open top containers with liquid to an accurately reproducible headspace level in each container, the apparatus including means for advancing a line of open top containers along a predetermined substantially straight path, through an elongated filling region, means for tilting the containers to a predetermined angle during their passage through at least a final portion of the filling region, means for discharging liquid in a stream extending longitudinally through the filling region in the direction of said predetermined path above the open tops of the containers, and means located in a transition region along the path of travel beyond the filling region for returning the containers to an upright condition, wherein the improvement comprises:

the means for advancing a line of open top containers comprises a feeder screw having a helical groove surrounding a longitudinal axis and mounted with said axis parallel to and spaced from the predetermined path of travel such that each turn of the helical groove engages one side of a different one of the containers in the line of containers, the feeder screw extending through at least the final portion of the filling region and through the transition region, and means for rotating the feeder screw about its longitudinal axis in a direction to advance the containers rapidly yet smoothly through at least the final portion of the filling region and the transition region without spilling any liquid as the tilted containers leave the filling region and return to an upright condition.

Additional elements, features, and advantages of the method and apparatus of the invention are described in connection with the accompanying drawings.

DETAILED DESCRIPTION OF THE PREFERRED EMBODIMENT

Figure 1:
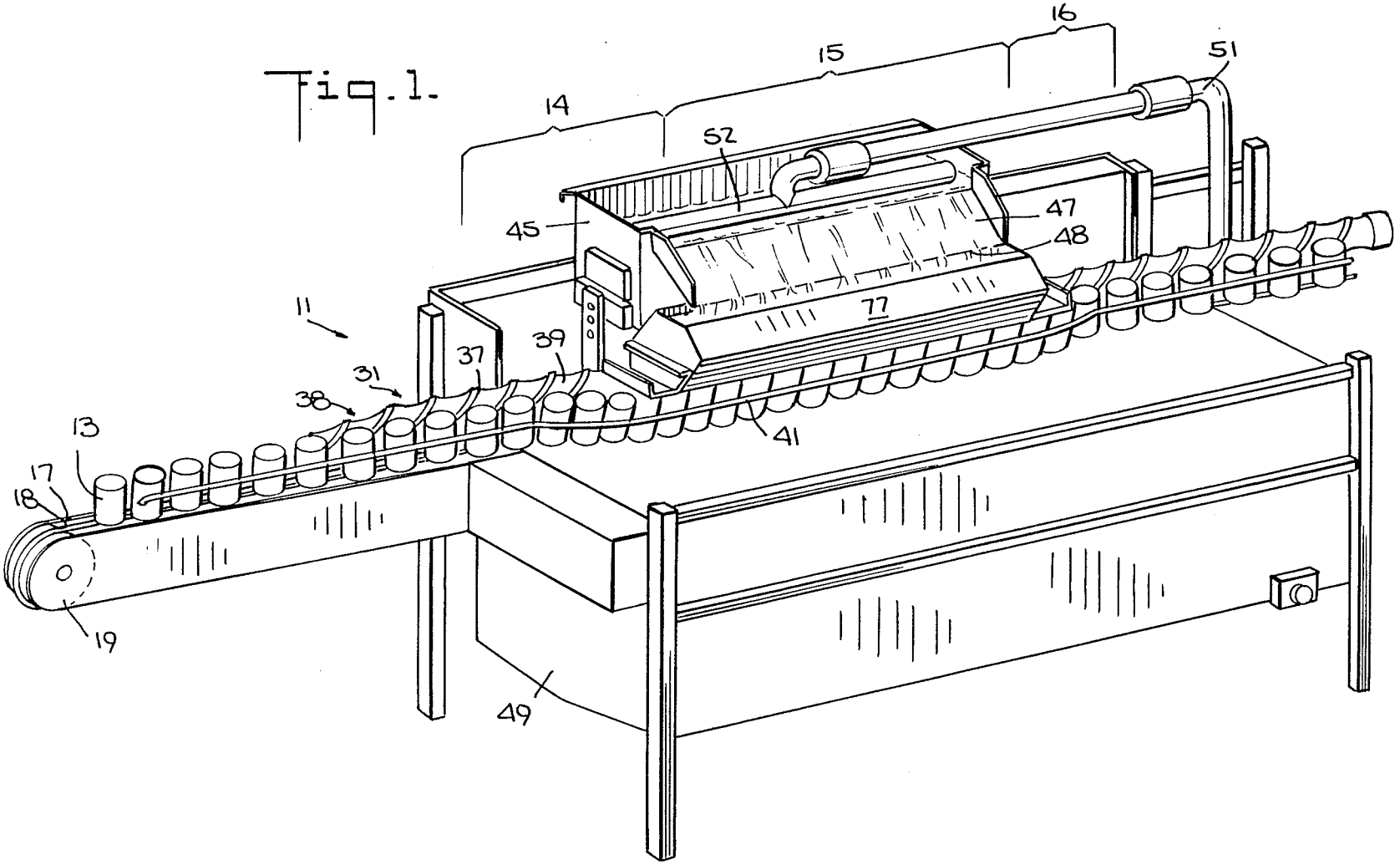
FIG. 1 is a simplified front perspective view of a liquid filling machine according to the invention.
Figure 2:
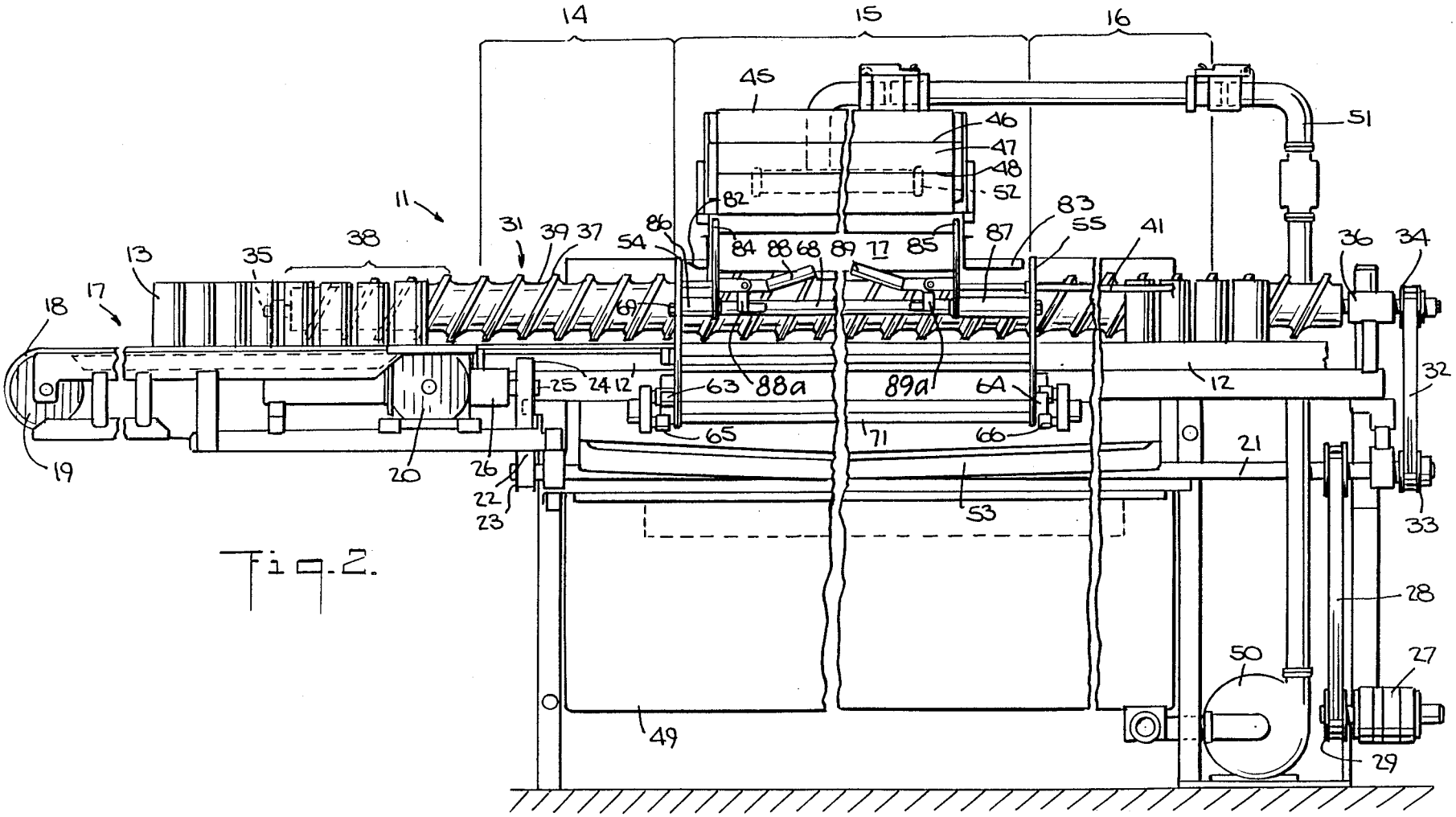
FIG. 2 is a front elevation view of the machine of FIG. 1.
Figure 3:
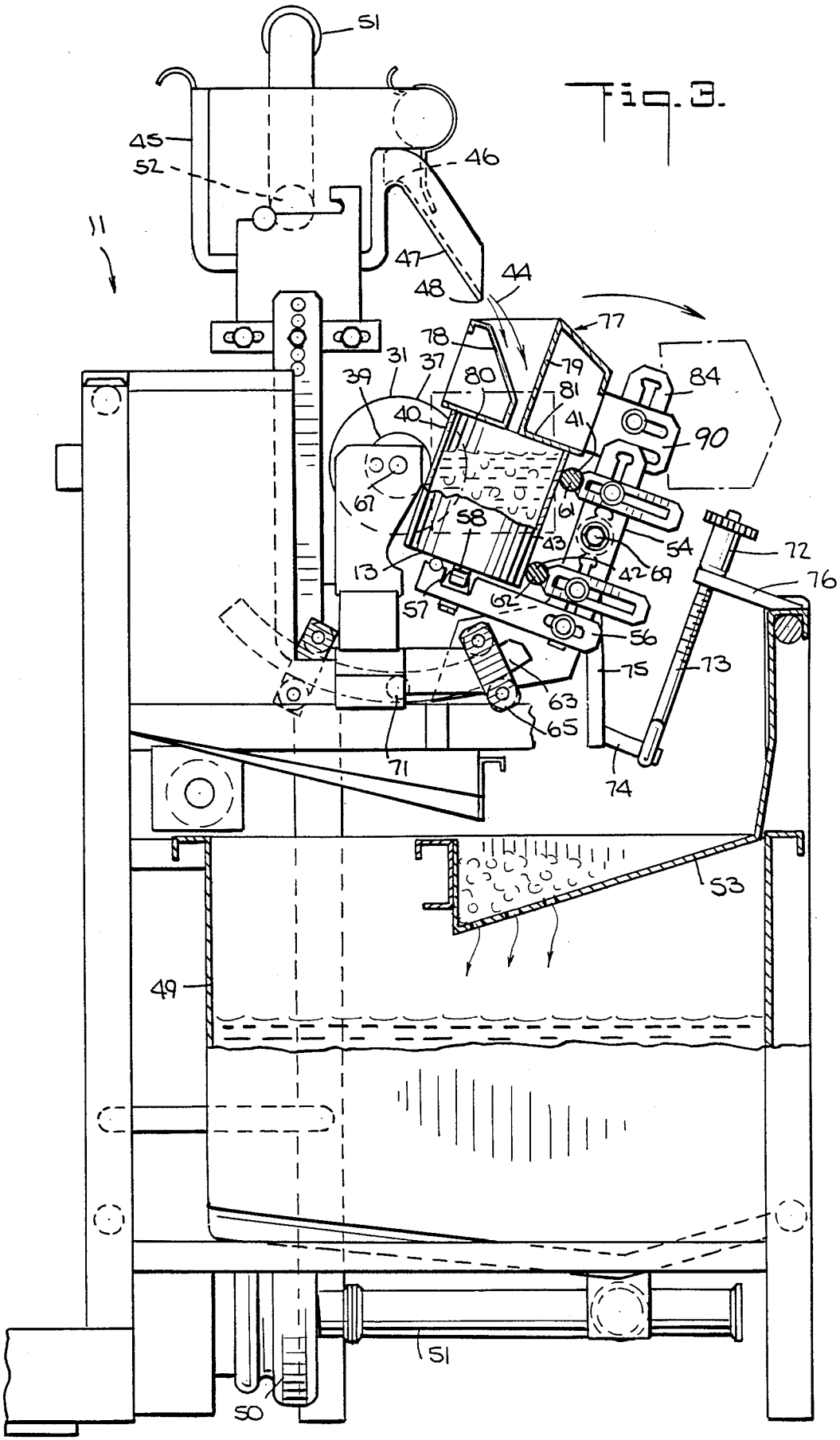
FIG. 3 is an end view in cross section taken along the line III—III of FIG. 2.
Figure 4:
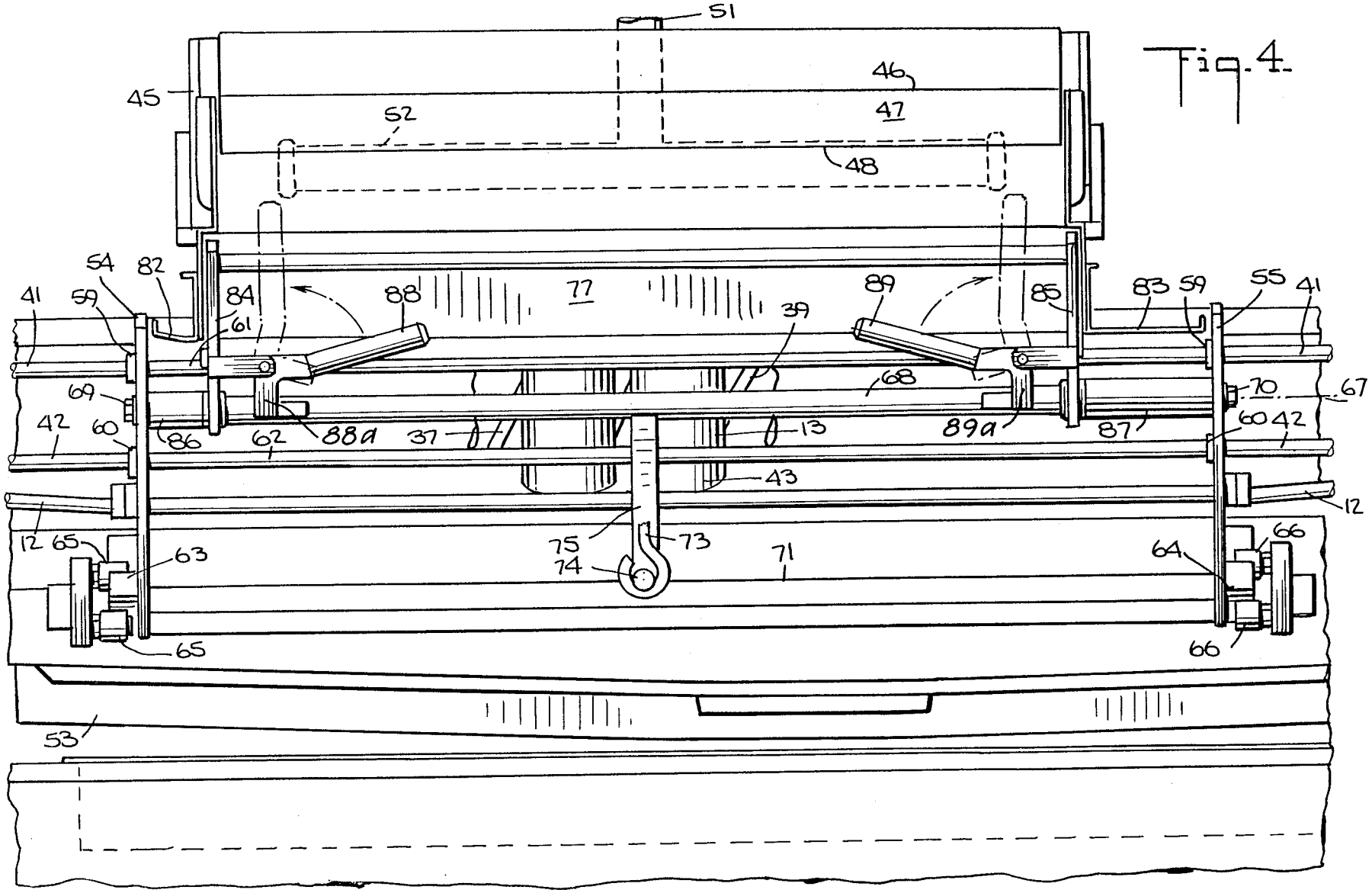
FIG. 4 is an enlarged partial front elevation view of the machine showing the filling region in more detail.
Figure 5:
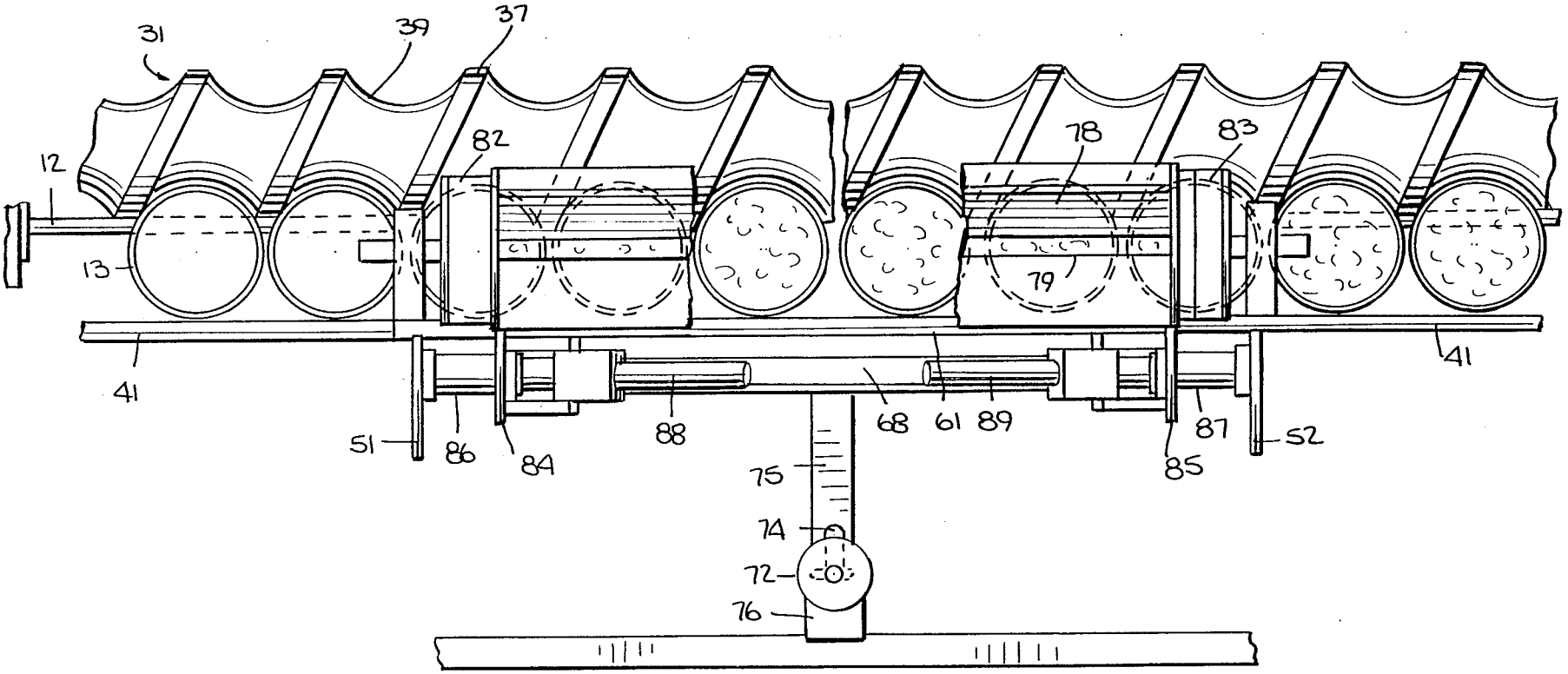
FIG. 5 is an enlarged partial top view taken along the line V—V in FIG. 3.

With reference to the figures, in which FIG. 1 is a simplified perspective view, FIGS. 2 and 3 are front and cross-sectional side views, and FIGS. 4 and 5 are closeup detailed views, a machine 11 for filling containers with liquid includes a container support bar 12 which defines a straight pathway for a line of containers 13 advancing through an infeed transition zone 14, a filling region 15, and an outfeed transition zone 16.

The containers enter the left hand side (FIGS. 1 and 2) of the machine sliding on a slotted deadplate 27 and carried forward by an endless chain 18 passing around an idler wheel 19 and a driving wheel 20. The driving wheel receives power from a drive shaft 21 delivered through a belt 22 and pulleys 23, 24 to an input shaft 25 of a right angle gear unit 26. A drive 27 from a seamer (not shown) rotates the drive shaft 21, through a belt 28 and pulleys 29, 30.

Drive shaft 21 also rotates a feeder screw 31 through a belt 32 and pulleys 33, 34. The feeder screw extends alongside the support bar 12 between a front support bearing 35 and a rear support bearing 36. The front bearing is located ahead of the entrance to the infeed transition zone and also ahead of the conveyor driving wheel. The front end of the feeder screw thus overlaps the rear end of the conveyor to provide positive transfer of control over container movement from the conveyor to the screw.

At that point, the containers move from the deadplate onto the support bar 12. Because the chain 18 and the feeder screw 31 are driven from the same shaft 21, they can be synchronized so that the containers move at the same rate on both the deadplate and the support bar. A similar deadplate and endless chain (not shown) may be provided at the outfeed end, the latter chain also being driven in synchronism with the feeder screw to provide a smooth transition of the containers into the next station, which is usually a seamer that seals tops onto the containers.

Feeder screw 31 is formed with a cylindrical outer surface 37 having a slightly tapered front portion 38 to provide a gradual lead-in for containers as they leave the conveyor. A helical groove 39 spirals around the feed screw at a pitch that at least equals the diameter of a container. The cross-sectional profile of the groove preferably conforms to the cross-sectional shape of a container; so that one side 40 of the containers will fit closely against the screw for smooth movement along the support bar as the screw rotates.

To hold the containers against the helical groove of the feeder screw, at least one (FIG. 1), and preferably two (FIG. 3), conventional guide rails 41, 42 extend parallel to the path in contact with the opposite side 43 of the containers. The guide rails may be rigid stainless steel bars or tubes, except in the transition zones 14 and 16, where they are made of flexible material, such as thermoplastic tubing. These flexible segments of the guide rails permit the rails in the filling region to be adjusted relative the rails ahead of the infeed zone and following the outfeed zone to allow the containers to tilt in the filling region, as will be described below. Similarly, the support bar 12 includes flexible portions (not shown) in the transition zones for the same purpose.

The structure in the filling region of the machine will be described next, with particular reference to FIGS. 3–5.

As the containers are advanced by the feeder screw through the machine, they are tilted gradually in the infeed zone to a predetermined angle (FIG. 3) in the filling region transverse to their line of travel, by means to be described below. Passing through this region, they are filled to overflowing with a liquid 44 delivered continuously from a supply tank 45. One side of tank 45 is bent down to form a weir 46 (FIG. 3) and a downwardly inclined plate 47 which has a discharge edge 48 positioned above the open tops of the line of containers along their path of advance.

Liquid is supplied continuously to the supply tank from a reservoir 49 through a transfer system including a pump 50, a conduit 51 and a header 52. The flow rate is adjusted so that the tilted containers overflow as they reach the outfeed (right hand) end of the filling region. The excess liquid falls back into the reservoir through a screened trough 53.

The previously mentioned means for tilting the containers to a predetermined angle, depending on the desired headspace in the filled container, includes a pair of longitudinally spaced brackets 54, 55, which are shaped like hockey sticks. Each bracket carries an adjustable arm 56 to which is bolted a rigid channel 57 that clamps a portion 58 of support bar 12 that extends through the filling region. This portion is of wedge-shaped cross section so that it is held securely by the side walls of channel 57. Each bracket also mounts two adjustable arms 59, 60 that are welded at their inner ends (left ends in FIG. 3) to rigid portions 61, 62 of the guide rails 41, 42 that extend through the filling region. As shown, the arms 56, 59, and 60 are adjustable laterally and in height to accommodate different sizes of containers, so that the support bar portion 58 can be centered under the containers when the containers are held in sliding contact with the groove in the feeder screw by the guide rail portions 61, 62.

The lower end of each bracket 54, 55 is welded or otherwise secured to a respective arcuate bar 63, 64. Each bar 63, 64 is slidably mounted in two pairs of respective support bearings 65, 66. The support bearings are positioned so as to locate the centers of curvature of the arcuate bars on the longitudinal axis 67 of the feeder screw (see FIG. 3).

The two brackets 54, 55 are held in spaced-apart relation by a non-rotating shaft 68 secured at opposite ends to the respective brackets by bolts 69, 70. Another shaft or bar 71 connects the arcuate bars 63, 64 to provide additional rigidity to the structure. Sliding movement of the arcuate bars in their bearing supports is adjustably controlled by means of a hand nut 72 mounted on a threaded eyebolt 73. The eye of bolt 73 engages a grooved pin 74 that is welded to the lower end of an arm 75, the upper end of which is welded to the non-rotating shaft 68. The bottom of the hand nut 72 bears against a stop 76 that is secured to the front frame of the machine.

As illustrated in FIG. 3, the tilt angle of the container supporting bracket structure can be adjusted, by turning the hand nut 72 on the eye bolt 73, between a position in which the containers are vertical (shown in broken lines) and a position in which the containers are at a maximum tilt angle (shown in solid lines). Since the movement between these positions is in an arc centered on the feeder screw axis, the containers merely rotate around the groove of the screw, without any lateral displacement of the containers on the portion 58 of the support bar or any relative movement of the guide rail portions 61, 62 with respect to the containers.

Another feature of this liquid filling apparatus is an elongated funnel 77 that is pivotally mounted to swing from a position between the discharge edge 48 and the tops of the containers (shown in solid lines) to a forward position (shown in broken lines) to permit access to remove a damaged container or to perform maintenance on the machine.

The elongated funnel 77 is formed with a pair of spaced apart walls 78, 79 that extend through the filling region parallel to the path of the containers. When the funnel is in the working position, the space between the walls is located under the discharge edge of the supply tank, and the walls converge downwardly so that the space narrows to a gap located approximately directly above a longitudinal centerline of the open tops of the containers (FIG. 3). This gap should be wide enough to pass a flow of liquid adequate to fill the containers to overflowing by the time they reach the downstream end of the filling region, yet it should be as narrow as possible so as to minimize loss of liquid between the containers.

At the top of the funnel, the space between walls 78 and 79 should be wide enough to assure that all liquid flowing over the discharge edge 48 will enter the funnel at all tilt angles within the range of adjustment of the container support structure.

The funnel further includes walls 80, 81 that extend laterally from the bottom edges of the respective side walls 78, 79 to form a lower baffle surface in closely spaced relation to the open tops of the containers to prevent washout of any solid product items (e.g., olives) that may have been introduced into the containers prior to their arrival at the filling region. Further protection against product washout is provided by a baffle plate 82 on the infeed end of the funnel 77 and by a baffle plate 83 on the outfeed end of the funnel (see FIGS. 2 and 4).

The previously mentioned pivoting capability of the funnel is achieved through means of a mounting arrangement that includes a pair of brackets 84, 85 that are adjustably connected to ears 90 attached to either end of the funnel (only one shown, FIG. 3). The lower ends of brackets 84, 85 are positioned by spacers 86, 87 that slip over the shaft 68 and are supported by retaining rings (e.g., plastic bushings) that are not shown. This arrangement permits the funnel support structure to pivot on shaft 68. Rotatable L-shaped handles 88 and 89 (FIGS. 2 and 4) lock the funnel into its operative position (solid lines, FIG. 3) when they are in the lowered position (solid lines, FIG. 4) by engaging shaft 68 with portions 88*a* and 89*a* and release the funnel when they are in the raised position (broken lines, FIG. 4) so it can pivot forward (broken lines, FIG. 3) for access to the containers.

Although the above description is of the presently preferred embodiment of the invention, a person of skill in the art will recognize that many changes can be made in the structure and arrangement of the machine within the scope of the invention. For example, the feeder screw could be shortened, if desired, so that its forward end is located inside the filling region, since the critical need for smooth feeding of the containers occurs in the final portion of the filling region and the outfeed transition zone, where they must be filled to an accurately reproducible headspace level and then returned, without splashing, to an upright condition.

I claim:

1. A method for topping up a line of rapidly moving open top containers with liquid to an accurately reproducible headspace level in each container, the method including advancing a line of open top containers along a predetermined substantially straight path through an elongated filling region, tilting the containers to a predetermined angle during their passage through at least a final portion of the filling region, and discharging liquid in a stream extending longitudinally through the filling region in the direction of said predetermined path above the open tops of the containers, and returning the containers to an upright condition after they leave the filling region, wherein the improvement comprises the step of advancing the line of containers comprises engaging successive containers in the line with successive turns of a feeder screw extending parallel to the predetermined path through at least said final portion of the filling region, and continuing said engagement at least until the containers have returned to the upright condition.

2. The method of claim 1 wherein the step of tilting the containers comprises tilting said containers prior to their entry into the filling region and maintaining a constant angle of tilt until the containers leave the filling region.

3. The method of claim 2 wherein the step of engaging the containers comprises engaging each container with said rotating feeder screw prior to the tilting step, and the tilting step comprises tilting the containers about the axis of the feeder screw.

4. The method of claim 1 wherein the step of returning the containers to the upright condition comprises rotating the containers about the axis of the feeder screw.

5. The method of claim 1 wherein the step of discharging liquid comprises:

discharging the liquid in a substantially uniform continuous sheet of unsupported flowing liquid from an elongated substantially straight discharge edge extending through the filling region in the direction of said predetermined path at a level spaced above the open tops of the containers.

6. The method of claim 5 wherein the step of discharging liquid further comprises:

guiding the uniform continuous sheet of flowing liquid between a pair of spaced apart walls extending through the filling region parallel to and below the discharge edge and above the open tops of the containers, the pair of walls converging downwardly to a gap located approximately directly above a longitudinal centerline of the open tops of the containers in the line of containers.

7. Apparatus for topping up a line of rapidly moving open top containers with liquid to an accurately reproducible headspace level in each container, the apparatus including means for advancing a line of open top containers along a predetermined substantially straight path, through an elongated filling region, means for tilting the containers to a predetermined angle during their passage through at least a final portion of the filling region, means for discharging liquid in a stream extending longitudinally through the filling region in the direction of said predetermined path above the open tops of the containers, and means located in a transition region along the path of travel beyond the filling region for returning the containers to an upright condition, wherein the improvement comprises:

the means for advancing a line of open top containers comprises a feeder screw having a helical groove surrounding a longitudinal axis and mounted with said axis parallel to and spaced from the predetermined path of travel such that each turn of the helical groove engages one side of a different one of the containers in the line of containers, the feeder screw extending through at least the final portion of the filling region and through the transition region, and means for rotating the feeder screw about its longitudinal axis in a direction to advance the containers rapidly yet smoothly through at least the final portion of the filling region and the transition region without spilling any liquid as the tilted containers leave the filling region and return to an upright condition.

8. Apparatus according to claim 7 wherein the means for discharging liquid comprises:

an elongated funnel having a pair of substantially straight spaced apart walls extending through the filling region above the open tops of the containers, the pair of walls converging downwardly to an elongated gap located approximately directly above a longitudinal centerline of the open tops of the containers in the line of containers.

9. Apparatus according to claim 7 wherein the means for tilting the containers comprises:

at least one longitudinal guide member for contacting an opposite side of each container in the line of containers along the predetermined path through at least the final portion of the filling region;

at least one bracket supporting the guide member; and means for adjusting the bracket in an arc centered on the longitudinal axis of the feeder screw so as to tilt the containers while maintaining engagement with the screw on the one side and contact with the guide member on the opposite side.

10. Apparatus according to claim 9 wherein the means for discharging liquid comprises:

an elongated funnel having a pair of substantially straight spaced apart walls extending through the filling region above the open tops of the containers, the pair of walls converging downwardly to an elongated gap located approximately directly above a longitudinal centerline of the open tops of the containers in the line of containers, each of the pair of walls terminating in a lower baffle surface that extends laterally outward from the gap in closely spaced relation to the open tops of the containers to prevent washout of any solid items that may have been introduced into the containers prior to their arrival at the filling region and means for mounting the funnel to the at least one bracket for maintaining a predetermined relation between the funnel and the guide member when the tilt angle of the bracket is adjusted.

11. Apparatus according to claim 10 wherein the means for mounting the funnel comprises means for adjusting the predetermined relation between the funnel and the guide member.

12. Apparatus according to claim 10 wherein the means for mounting the funnel comprises means for releasably maintaining a predetermined relation between the funnel and the guide member and means for pivotally supporting the funnel for movement between a first position which determines said predetermined relation and a second position which permits access to the containers in the filling region.

* * * * *